US009995138B2

(12) United States Patent
Burger

(10) Patent No.: US 9,995,138 B2
(45) Date of Patent: Jun. 12, 2018

(54) DEVICE FOR SINKING A SHAFT AND METHOD FOR SINKING A SHAFT

(71) Applicant: Herrenknecht Aktiengesellschaft, Schwanau (DE)

(72) Inventor: Werner Burger, Schwanau (DE)

(73) Assignee: HERRENKNECHT AKTIENGESELLSCHAFT, Schwanau (DE)

( * ) Notice: Subject to any disclaimer, the term of this patent is extended or adjusted under 35 U.S.C. 154(b) by 294 days.

(21) Appl. No.: 14/897,071

(22) PCT Filed: Jun. 2, 2014

(86) PCT No.: PCT/EP2014/061374
§ 371 (c)(1),
(2) Date: Dec. 9, 2015

(87) PCT Pub. No.: WO2014/206688
PCT Pub. Date: Dec. 31, 2014

(65) Prior Publication Data

US 2016/0130942 A1 May 12, 2016

(30) Foreign Application Priority Data

Jun. 25, 2013 (DE) ..... 10 2013 212 098

(51) Int. Cl.
*E21D 1/06* (2006.01)

(52) U.S. Cl.
CPC ..... *E21D 1/06* (2013.01)

(58) Field of Classification Search
CPC .... E21D 1/06; E21D 1/00; E21D 1/04; E21B 4/18
USPC ..... 299/58
See application file for complete search history.

(56) References Cited

U.S. PATENT DOCUMENTS

| | | | | |
|---|---|---|---|---|
| 3,965,995 | A | 6/1976 | Sugden | |
| 4,274,675 | A * | 6/1981 | Paurat | E21B 4/16 175/102 |
| 4,646,853 | A | 3/1987 | Sugden et al. | |
| 4,732,226 | A * | 3/1988 | Ebeling | E21B 4/16 175/102 |
| 2011/0139511 | A1* | 6/2011 | Burger | E21D 1/06 175/57 |
| 2012/0318581 | A1* | 12/2012 | Webb | E21D 1/06 175/57 |
| 2015/0308265 | A1* | 10/2015 | Burger | E21D 1/06 299/64 |

FOREIGN PATENT DOCUMENTS

| | | |
|---|---|---|
| DE | 19 04 684 | 8/1970 |
| DE | 26 57 573 | 6/1978 |

(Continued)

OTHER PUBLICATIONS

International Search Report dated Jul. 21, 2015 in PCT/EP2014/061374.

*Primary Examiner* — Michael R Wills, III
(74) *Attorney, Agent, or Firm* — Faegre Baker Daniels LLP

(57) ABSTRACT

A device and method for sinking a shaft during a sinking cycle, in which a support unit is moved once and a boring unit is moved at least twice by means of support cylinders and displacement cylinders. Due to such configuration, an efficient sinking operation is obtained.

16 Claims, 16 Drawing Sheets

(56) References Cited

FOREIGN PATENT DOCUMENTS

| | | |
|---|---|---|
| DE | 30 11 578 | 10/1981 |
| DE | 10 2012 025 395 | 6/2014 |
| EP | 0 316 931 | 5/1989 |
| FR | 1 463 945 | 7/1966 |

* cited by examiner

IX-IX

X-X

XII-XII

XII-XII

XV-XV

XVI-XVI

DEVICE FOR SINKING A SHAFT AND METHOD FOR SINKING A SHAFT

This application is a U.S. National Phase Patent Application based on International Application No. PCT/EP2014/061374 filed Jun. 2, 2014, which claims priority to German Patent Application No. 10 2013 212 098.2 filed Jun. 25, 2013, the entire disclosures of which are hereby explicitly incorporated by reference herein

BACKGROUND OF INVENTION

1. Field of the Invention

The present invention relates to a device for sinking a shaft. The invention further relates to a method for sinking a shaft.

2. Description of the Related Art

A generic device and a method for sinking a shaft are known from DE 19 04 684 A1. The generic device for sinking a shaft has a carrier unit, situated on the rear side in the sinking direction, which is connected to a suspension unit which has only one axial operating direction that faces in the direction of the boring unit. In addition, a boring unit situated on the front side in the sinking direction is present, the carrier unit and the boring unit being connected via a number of carrier cylinders which operate in the sinking direction, and the boring unit having a number of bracing modules for radial and axial bracing, a number of displacement cylinders which operate in the sinking direction, and a bore head which is connected to the displacement cylinders and which is configured for sinking the shaft when bracing modules are activated for bracing. As platforms, the boring unit according to the generic prior art has an auxiliary platform and a working platform, both of which are independently radially and axially braceable via their own bracing modules. The carrier cylinders are situated between the carrier unit and the auxiliary platform, while the displacement cylinders are situated between the auxiliary platform and the working platform. In the generic method, the auxiliary platform and the working platform are alternately released and braced in the manner of a walking mechanism, and therefore must be correctly placed in relative alignment with one another after each releasing and bracing operation. A corresponding device and a corresponding method are also known from DE 26 57 573 A1. A further device and method for sinking a shaft are known from U.S. Pat. No. 4,646,853. This device has a carrier unit situated on the rear side in the sinking direction and a boring unit situated on the front side in the sinking direction. The carrier unit and the boring unit are connected to one another via a number of carrier cylinders which operate in the sinking direction. The boring unit has a number of bracing modules for radial and axial bracing, a number of displacement cylinders which operate in the sinking direction, and a bore head which is connected to the displacement cylinders and which is configured for sinking the shaft when bracing modules are activated for bracing. In addition, the generic device is equipped with securing modules, which are mounted on the carrier unit and which are configured for radially and axially bracing the carrier unit intermittently in alternation with bracing of the boring unit.

During sinking of a shaft, a sinking cycle begins with activation of the bracing modules and the securing modules for bracing the boring unit and the carrier unit. The carrier cylinders are fully extended, while the displacement cylinders are retracted. After the bore head starts operation, the displacement cylinders are maximally extended until the maximum sinking depth is reached during a sinking cycle. The displacement cylinders are subsequently fully retracted and lift the bore head. The securing modules are then deactivated and the carrier cylinders are retracted, so that the carrier unit is lowered, while the boring unit remains braced. The securing modules are subsequently reactivated, so that the carrier unit is braced. The bracing modules are then deactivated, and the boring unit which is thus released is lowered by extending the carrier cylinders. The bracing modules are subsequently reactivated for axially and radially bracing the boring unit, so that a new sinking cycle may begin.

SUMMARY OF THE INVENTION

The present invention provides a device and a method for sinking a shaft, with which a shaft may be efficiently sunk.

According to the invention, at least two advancing strokes of the boring unit, which has only a single boring platform to be braced, may now be carried out between two lowering strokes of the carrier unit, which in the device according to the invention is only fastened in a suspended manner and in particular is not braced in the axial direction, which keeps the setup times between successive sinking cycles relatively short.

In one form thereof, the present invention provides a device for sinking a shaft, in particular for carrying out a method according to one of claims 7 to 10, including a carrier unit (2) situated on the rear side in the sinking direction and a boring unit (3) situated on the front side in the sinking direction, the carrier unit (2) and the boring unit (3) being connected to one another via a number of carrier cylinders (11) which operate in the sinking direction, and the boring unit (3) having a number of bracing modules (15) for radial and axial bracing, a number of displacement cylinders (13) which operate in the sinking direction, and a bore head (14) which is connected to the displacement cylinders (13) and which is configured for sinking the shaft (1) when bracing modules (15) are activated for bracing, characterized in that the carrier unit (2) is connected to a suspension unit (10), which has only one axial operating direction that faces in the direction of the boring unit (3), and via which the carrier unit (2) is positionable in various axial cycle start positions in the axial direction, against the force of gravity.

BRIEF DESCRIPTION OF THE DRAWINGS

Further advantageous embodiments and advantages of the invention result from the following description of exemplary embodiments, with reference to the figures of the drawing, which show the following.

Figure 1:
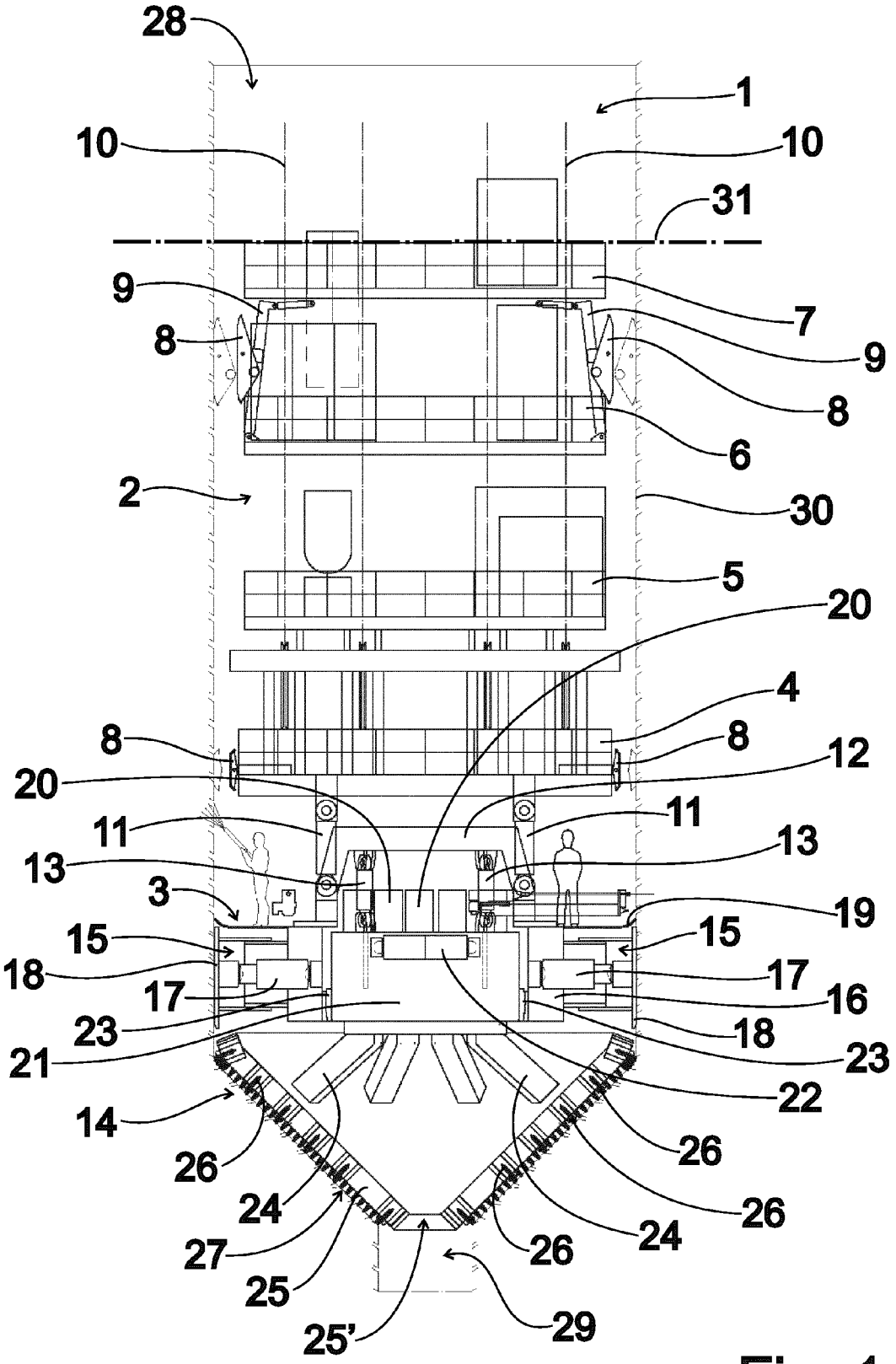
FIG. 1 is a schematic side view of one exemplary embodiment of a device according to the invention at the beginning of a sinking cycle, having a carrier unit and a boring unit which are separated at a minimal distance from one another.
Figure 2:
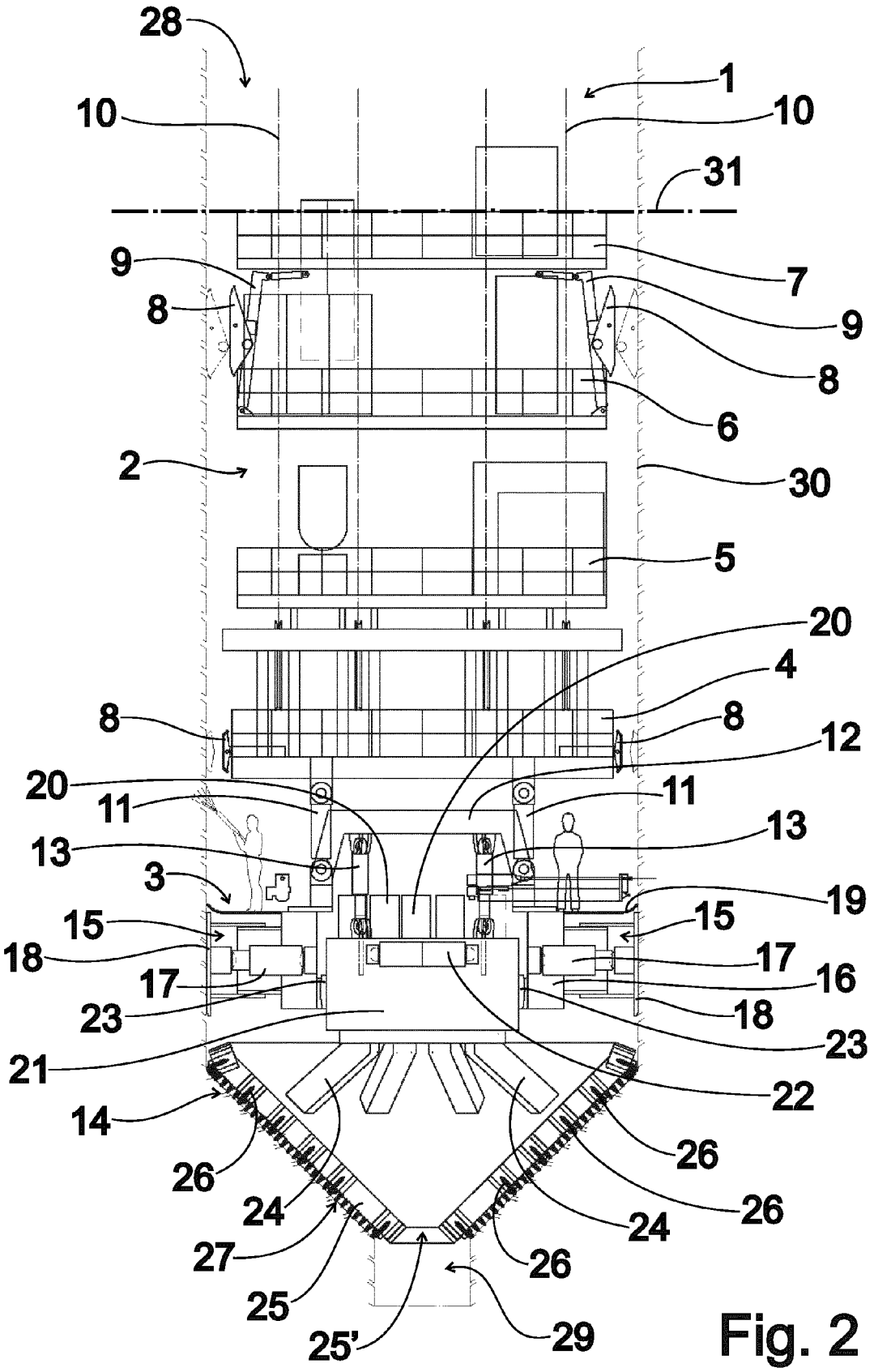
FIG. 2 is a schematic side view of the exemplary embodiment according to FIG. 1, with a bore head of the boring unit, which with respect to the arrangement according to FIG. 1 is advanced in the sinking direction via displacement cylinders.
Figure 3:
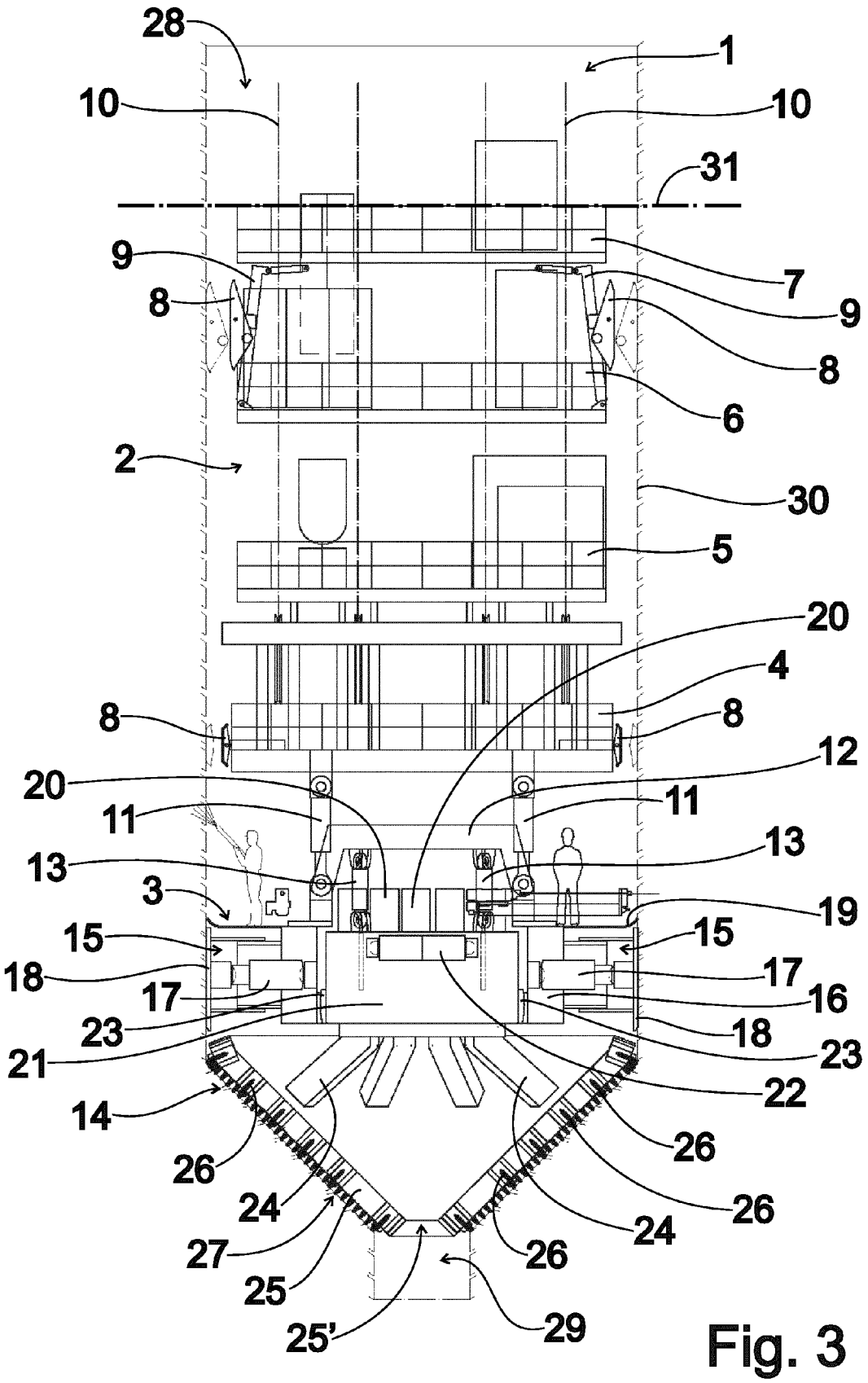
FIG. 3 is a schematic side view of the exemplary embodiment according to FIG. 1, with a boring unit which is lowered with respect to the arrangement according to FIG.
Figure 4:
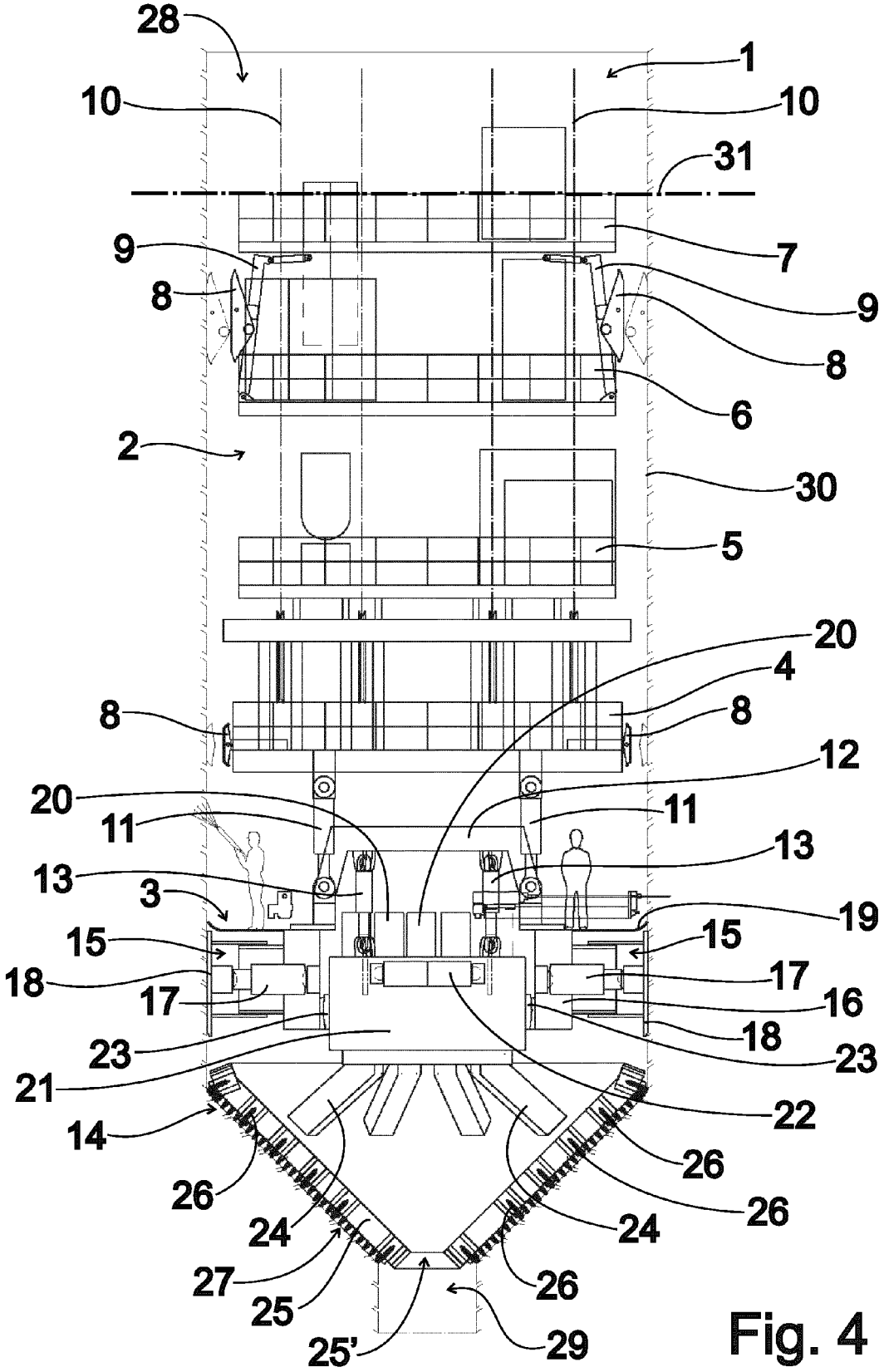
Figure 5:
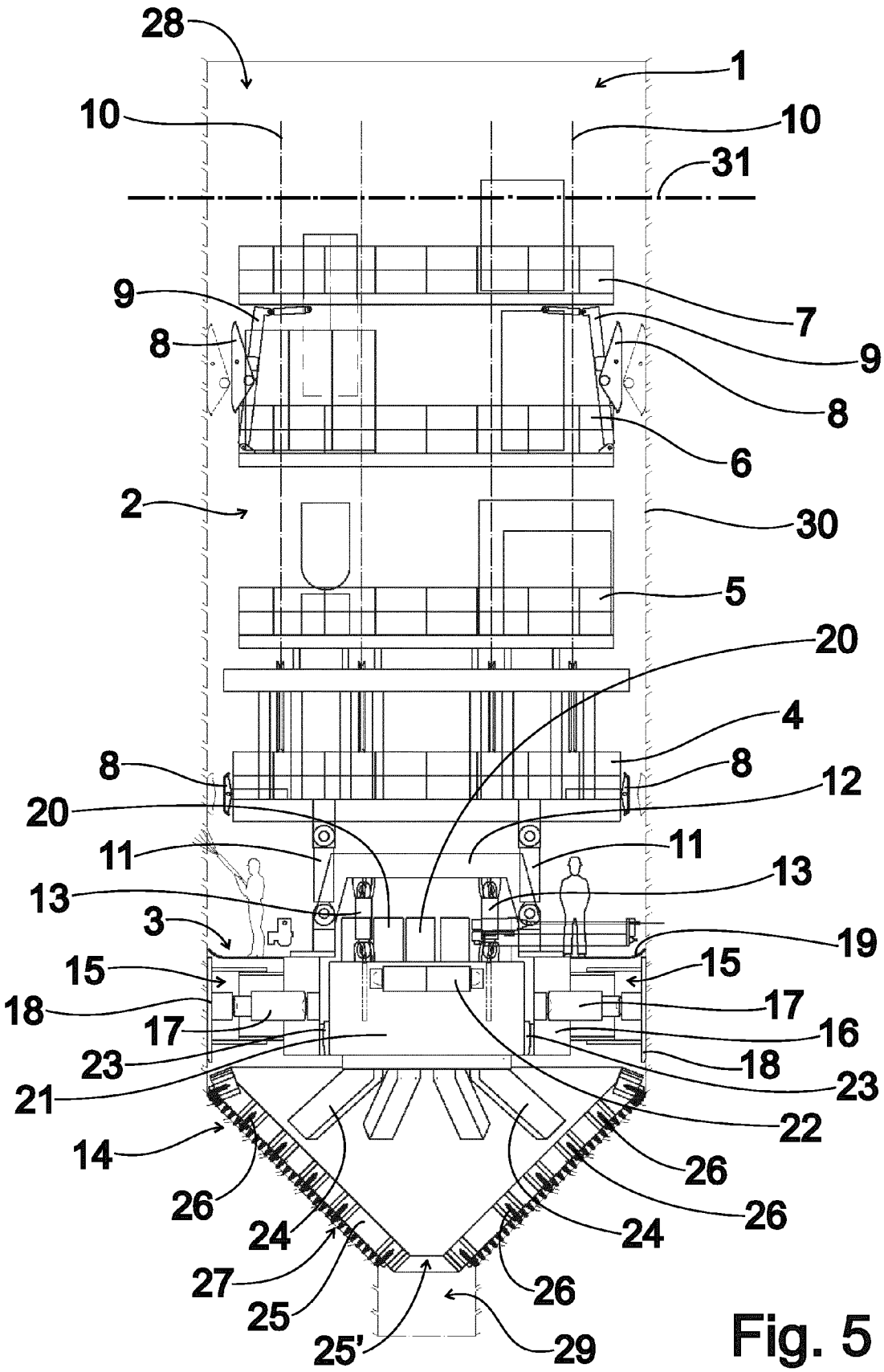
Figure 6:
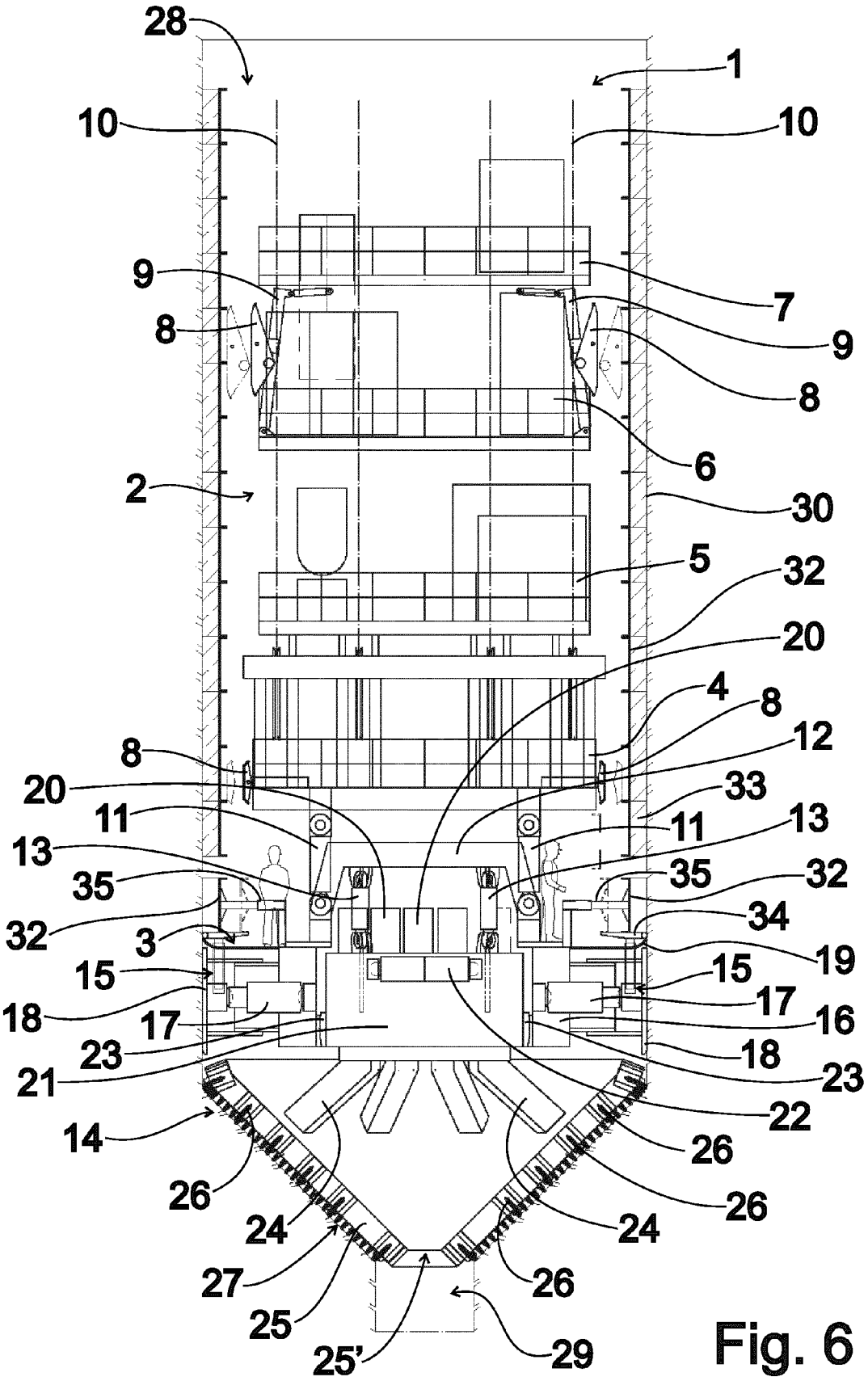
Figure 7:
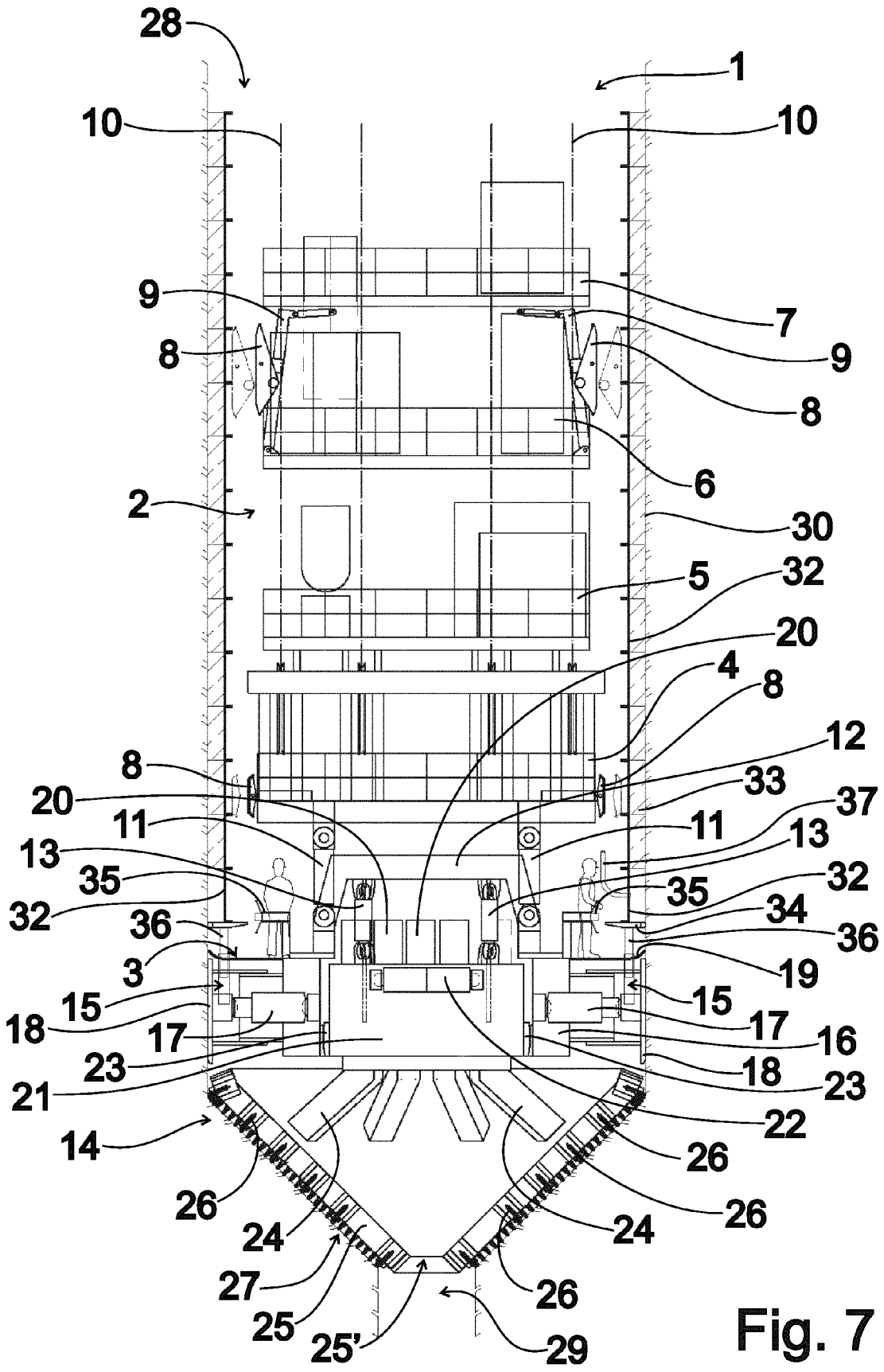
Figure 8:
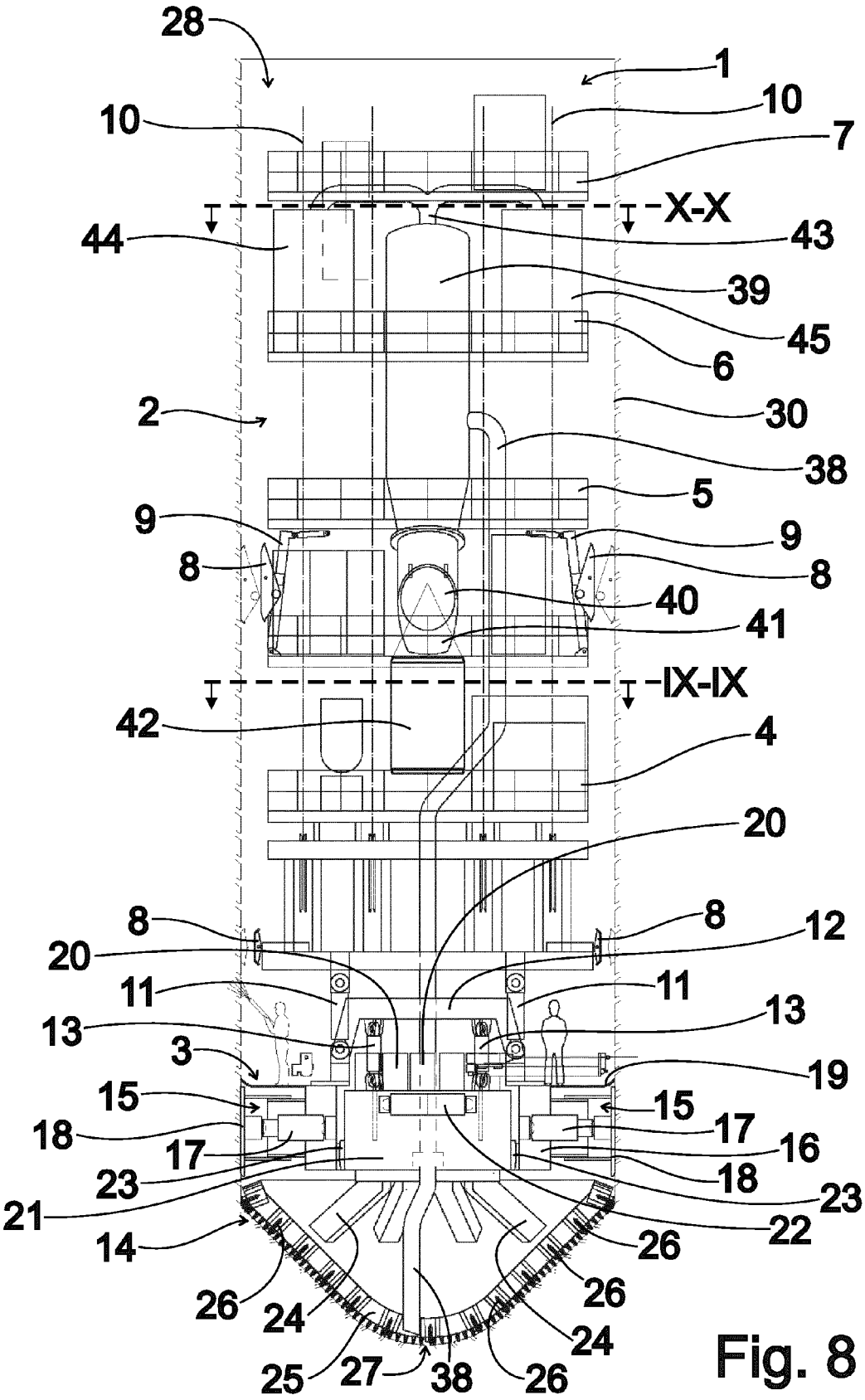
Figure 9:
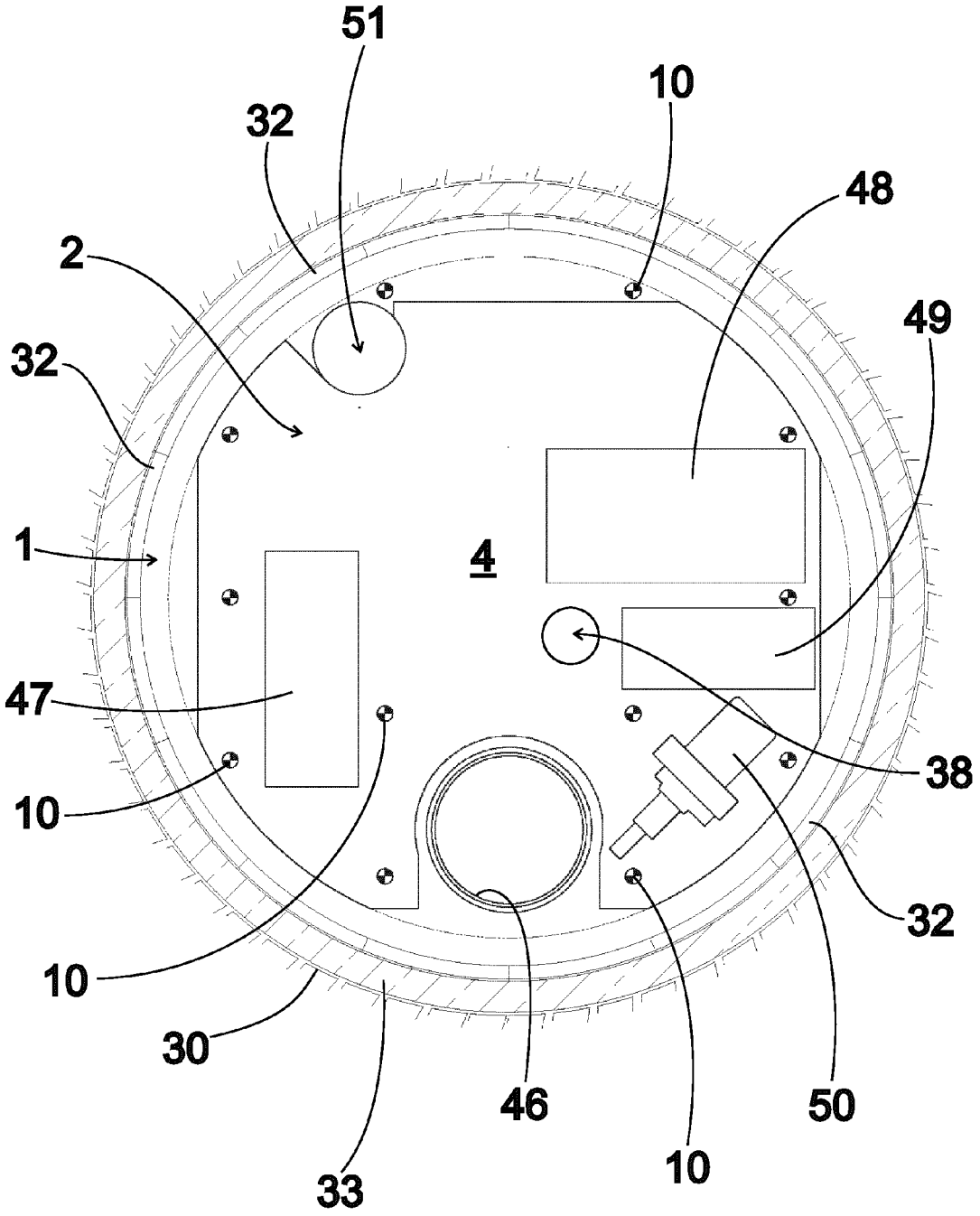
Figure 10:
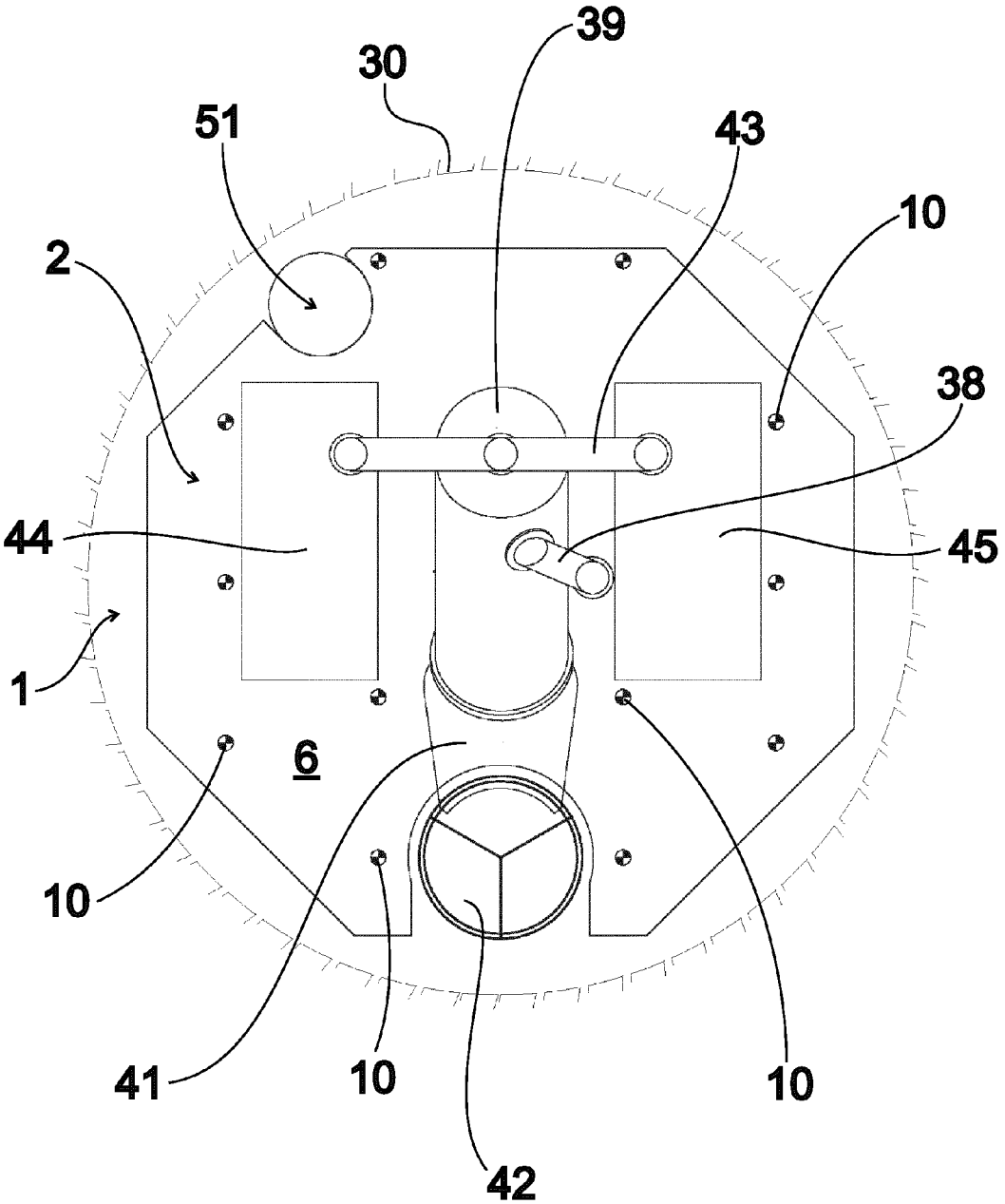
Figure 11:
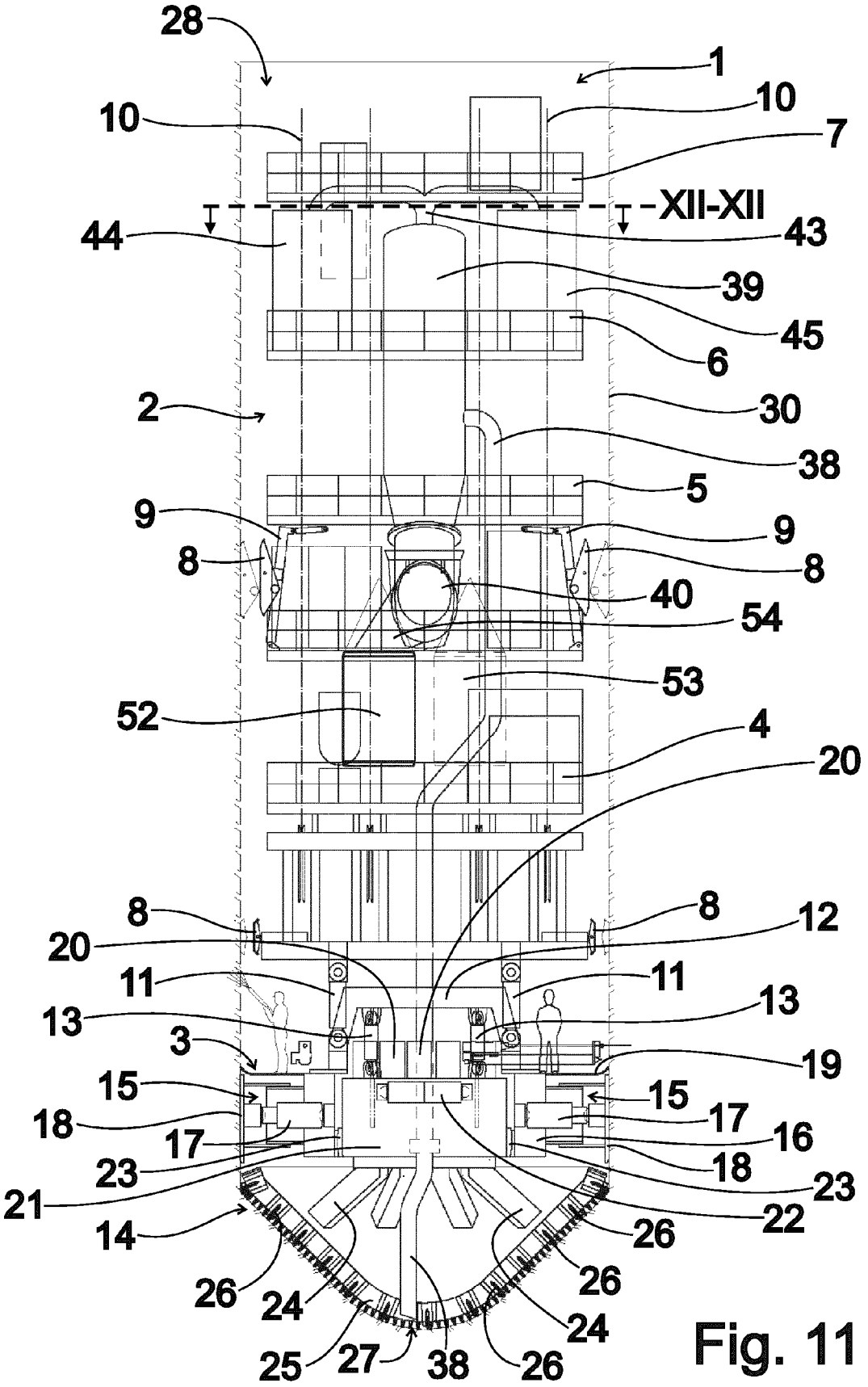
Figure 12:
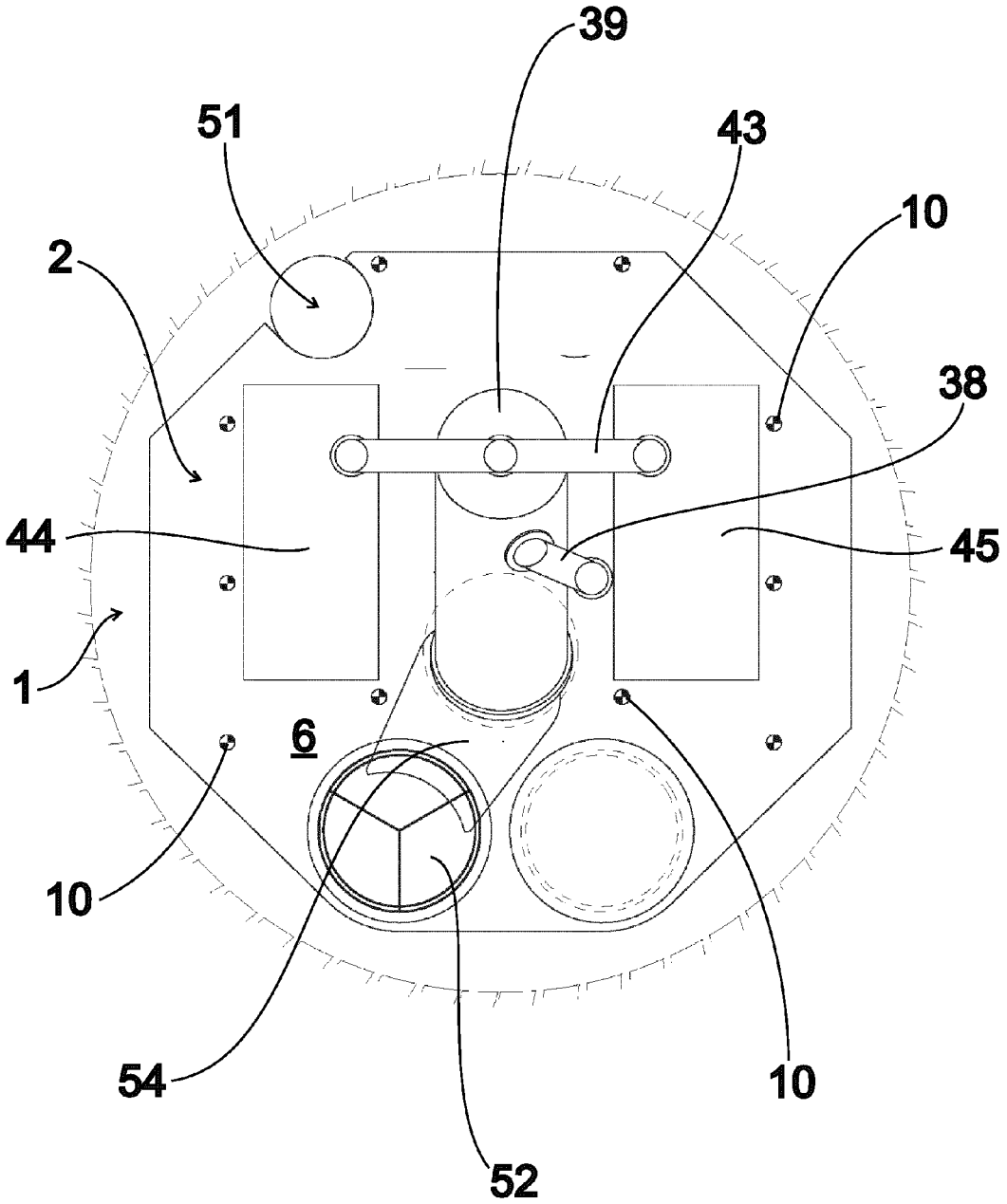
Figure 13:
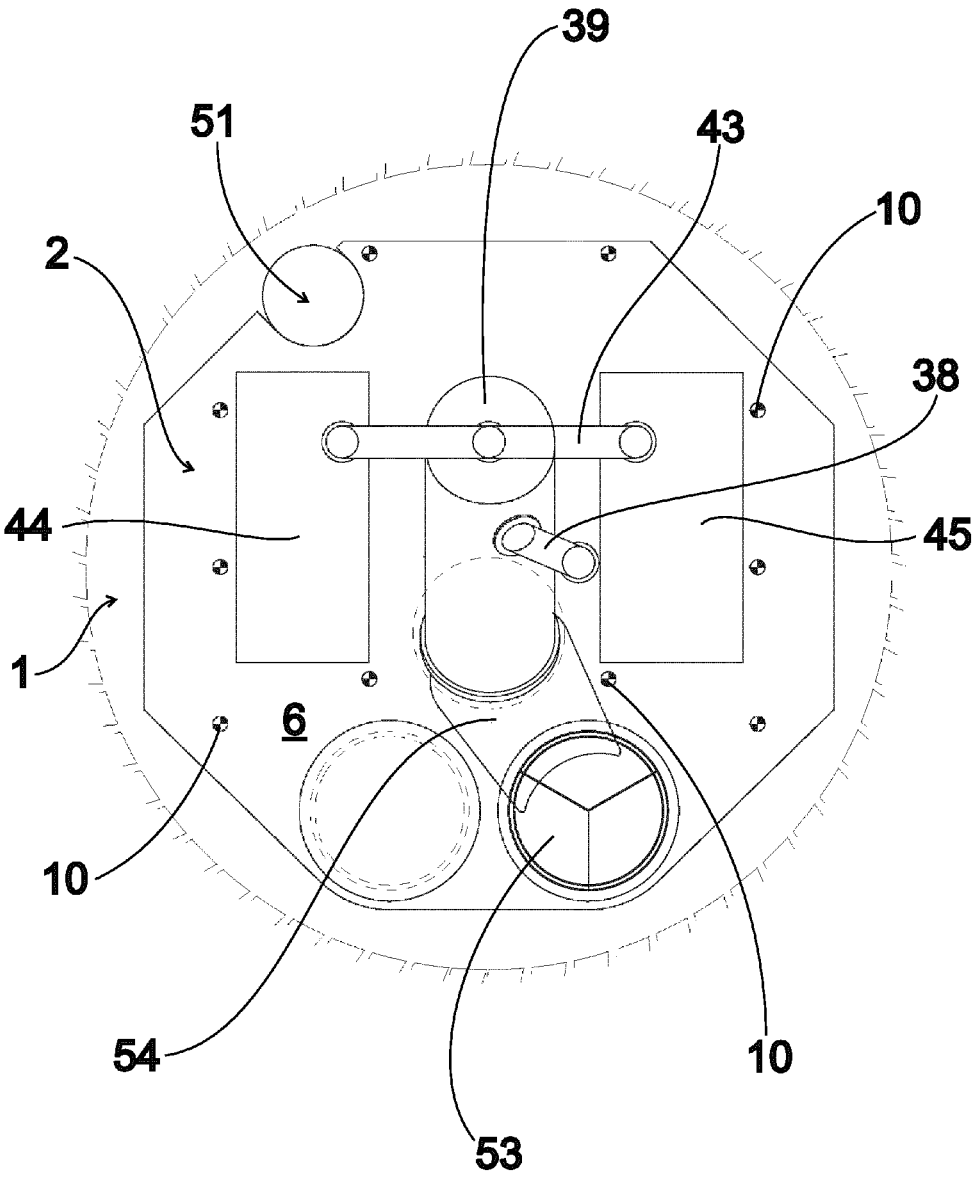
Figure 14:
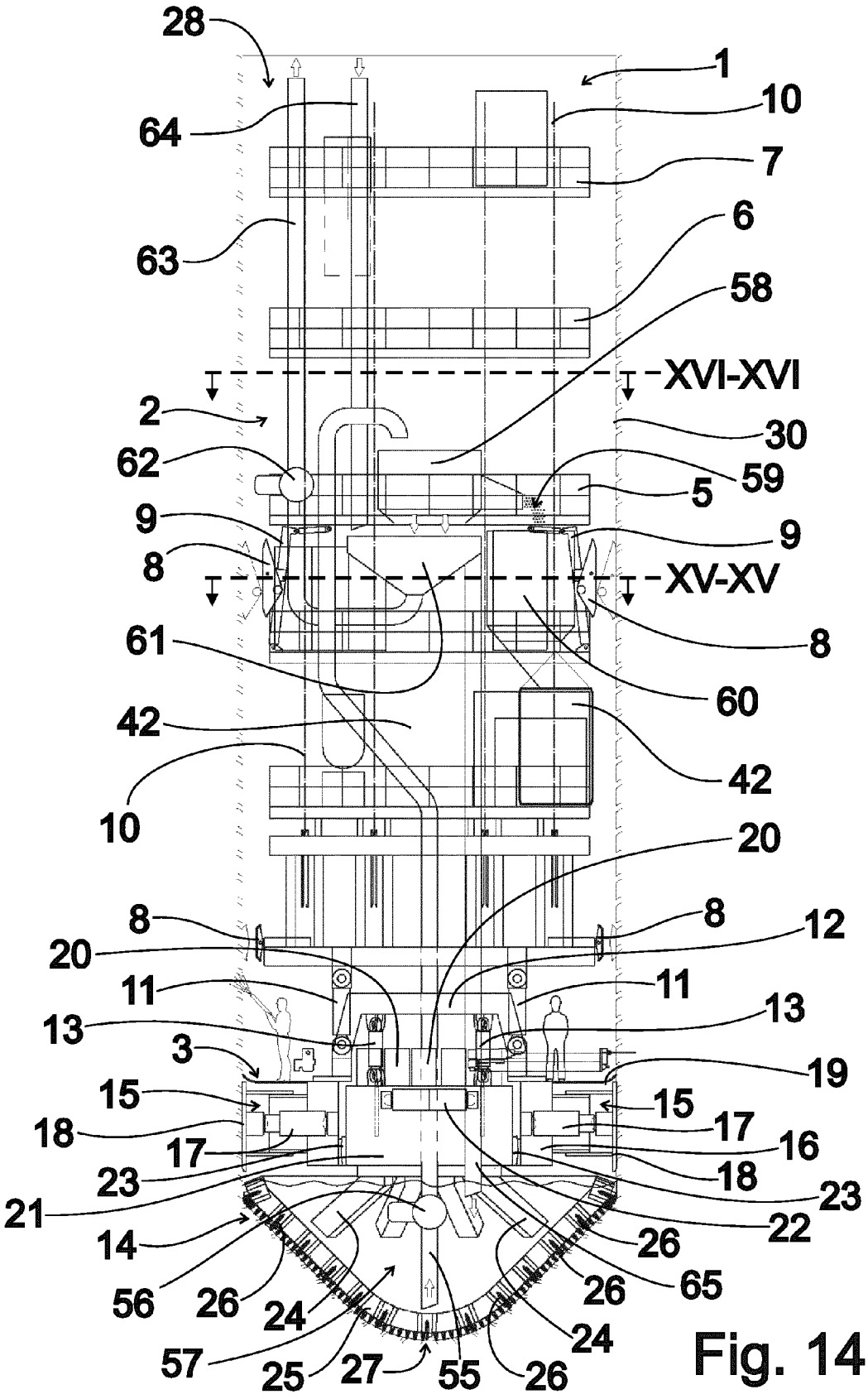
Figure 15:
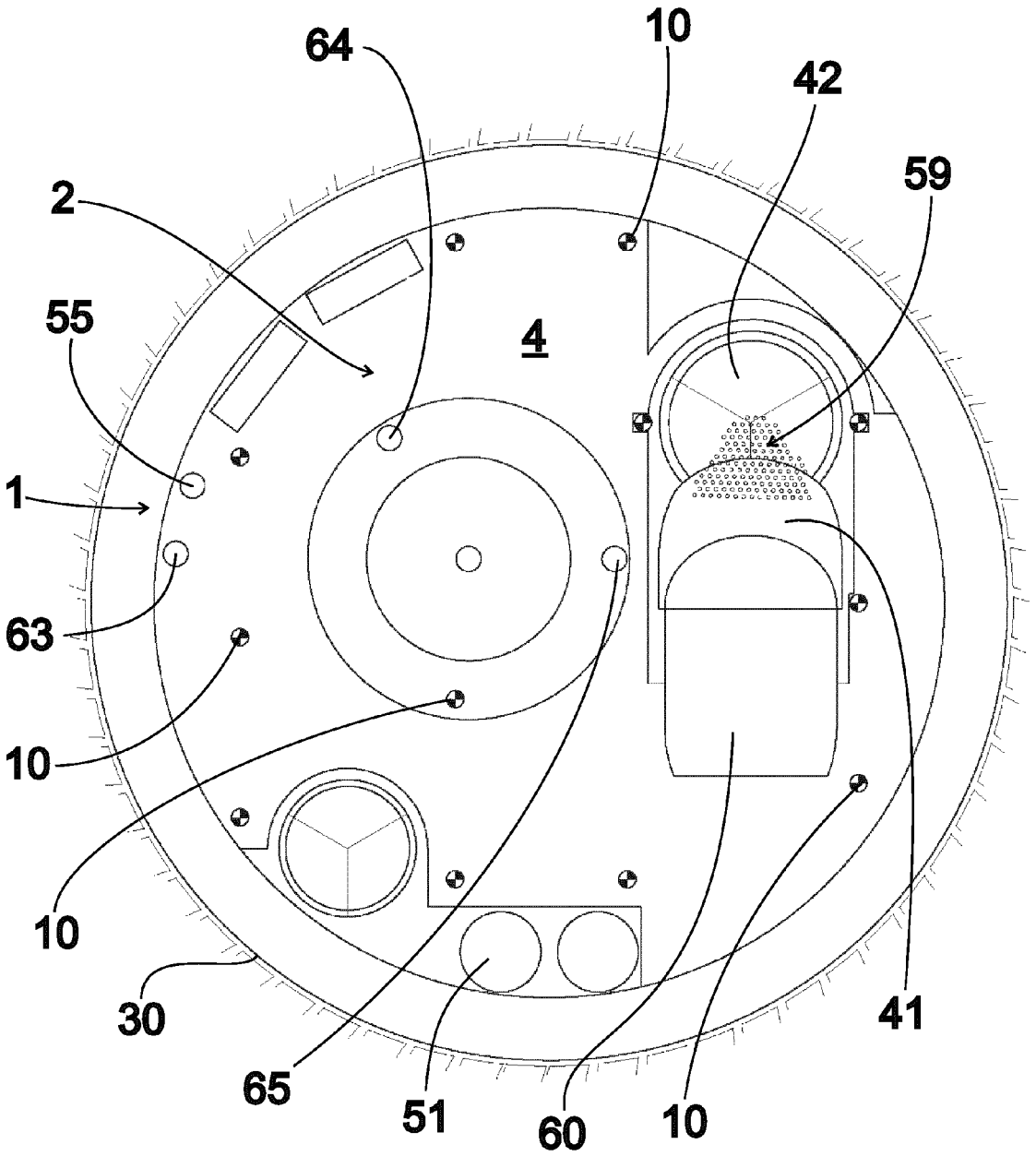
Figure 16:
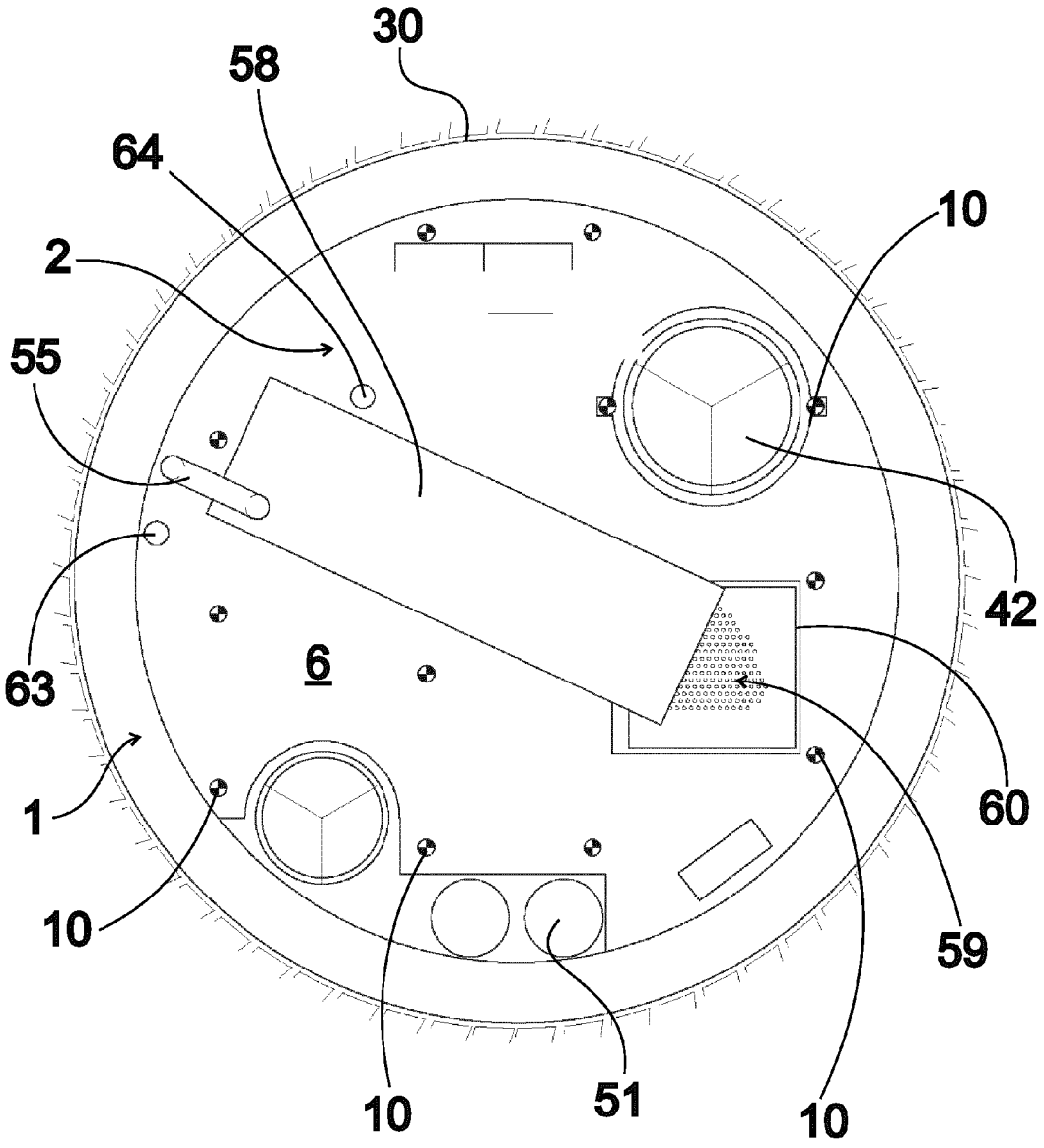

1 via carrier cylinders, and a bore head which is retracted with respect to the arrangement according to FIG. 2;

FIG. 4 is a schematic side view of the exemplary embodiment according to FIG. 1, with a bore head which is advanced in the sinking direction by means of the displacement cylinders, corresponding to the arrangement according to FIG. 2, starting from the arrangement according to FIG. 3;

FIG. 5 is a schematic side view of the exemplary embodiment according to FIG. 1 at the beginning of a next sinking cycle, with a carrier unit and boring unit which together are displaced, relative to the arrangement according to FIG. 1, in the sinking direction;

FIG. 6 is a schematic side view of a refinement of the exemplary embodiment according to FIGS. 1 through 5, which is configured for lining the wall of the shaft with tubings;

FIG. 7 is a schematic side view of the exemplary embodiment according to FIG. 6 in the final assembly of a tubing ring;

FIG. 8 shows a schematic side view of another exemplary embodiment of a device according to the invention, with a conveying unit which includes a conveyor bucket;

FIG. 9 is a sectional view of the exemplary embodiment according to FIG. 8;

FIG. 10 shows, in another sectional view through the carrier unit, the exemplary embodiment according to FIG. 8;

FIG. 11 is a schematic side view of a refinement of the exemplary embodiment of a device according to the invention according to FIGS. 8 through 10, with a conveying unit which includes two conveyor buckets FIG. 12 shows, in a sectional view through a carrier unit, the refinement according to FIG. 11, with a swivel chute which is oriented toward a conveyor bucket;

FIG. 13 shows, in a sectional view through the carrier unit, the refinement according to FIG. 11, with the swivel chute oriented toward the other conveyor bucket;

FIG. 14 shows a schematic side view of another exemplary embodiment of a device according to the invention which is designed with a hydraulic conveying unit;

FIG. 15 is an exemplary embodiment according to FIG. 14 in a sectional view; and FIG. 16 is another sectional view of the exemplary embodiment according to FIG. 14;

Corresponding reference characters indicate corresponding parts throughout the several views. Although the exemplification set out herein illustrates an embodiment of the invention, the embodiment disclosed below is not intended to be exhaustive or to be construed as limiting the scope of the invention to the precise form disclosed.

DETAILED DESCRIPTION

FIG. 1 shows a schematic side view of one exemplary embodiment of a device according to the invention for sinking a main shaft 1 as a shaft in a direction which extends essentially vertically, following the direction of the force of gravity. The exemplary embodiment according to FIG. 1 has a carrier unit 2 situated on the rear side in the sinking direction, and a boring unit 3 situated on the front side in the sinking direction.

The carrier unit 2 has a number of shaft platforms 4, 5, 6, 7 which extend radially over the largest region of the cross section of the main shaft 1 and which are situated one above the other in the sinking direction when properly arranged in the main shaft 1. Radial stabilizers 8 are present for stabilizing the carrier unit 2 in the radial direction. A group of radial stabilizers 8 is mounted on the shaft platform 4 on the shaft floor side, closest to the boring unit 3. Another group of radial stabilizers 8 is fastened to braces 9 which extend between the shaft platform 7 on the shaft opening side, situated farthest from the shaft platform 4 on the shaft floor side, and a shaft platform 6, situated in between, adjacent to the shaft platform 7 on the shaft floor side, and are connected to same.

The radial stabilizers 8 are configured only for stabilizing the carrier unit 2 against movement in the radial direction without play. However, the radial stabilizers 8 are not configured for bracing the carrier unit 2 in the radial and axial directions of the main shaft 1, in the sense that the carrier unit 2 is able to absorb forces which stabilize the boring unit 3 in the radial and axial directions during operation of the boring unit 3 for sinking the main shaft 1.

In addition, mounted on the shaft platform 4 on the shaft floor side are a number of cables 10 of a suspension unit which extend through the main shaft 1, away from the carrier unit 2.

Mounted on the shaft platform 4 on the shaft floor side, opposite from the boring unit 3, are a number of carrier cylinders 11 which operate in the sinking direction and which extend away from the shaft platform 4 on the shaft floor side, in the direction of the boring unit 3, and which are connected to the boring unit 3.

The boring unit 3 has a support frame 12 on which the carrier cylinders 11 on the one hand, and displacement cylinders 13 which operate in the sinking direction on the other hand, are mounted, which extend away from the shaft platform 7 on the shaft floor side in the direction of a bore head 14 of the boring unit 3, and are connected to same.

In addition, it is apparent from the illustration according to FIG. 1 that the boring unit 3 is equipped with a number of bracing modules 15 which engage with a boring platform 16 of the boring unit 3 and which are equipped with bracing cylinders 17 which extend in the radial direction, are connected to the boring platform 16 on the radially inner side, and are provided with bracing plates 18 on the radially outer side. The bracing modules 15 are configured for bracing the boring unit 3 radially as well as axially in such a way that essentially all forces generated during operation of the boring unit 3 for sinking the main shaft 1, in particular generated by the bore head 14, are absorbed by the boring unit 3.

The boring unit 3 advantageously has an outer sealing collar 19 which is adaptable to the cross section of the main shaft 1 in the radial direction, optionally while maintaining a minimal residual gap that is unobjectionable with regard to safety, and which radially closes off the boring unit 3 with respect to the carrier unit 2 in the area of the boring platform 16.

The bore head 14 is equipped with a number of drive motors 20 via which a rotary drive 21, which is stabilized by a support cylinder 22, is drivable for rotation about a rotary axis extending in parallel to the sinking direction. The rotary drive 21 is supported with respect to the boring platform 16 by a bore head drive bearing 23, and has a number of drive arms 24 which extend between the rotary drive 21 and an excavation bevel gear 25. The excavation bevel gear 25 has a discharge opening 25' in its area situated farthest from the rotary drive 23.

The excavation bevel gear 25 is fitted with a number of excavation tools 26, and extends in the sinking direction along a main shaft floor 27, having a complementary conical shape, facing radially outwardly away from the boring platform 16 in the arrangement according to FIG. 1, to a pilot shaft 29, which has a much smaller cross section compared to the main shaft 1, and which extends, in an extension of the main shaft 1, from a main shaft opening 28 in the sinking direction. The discharge opening 25' opens into the pilot shaft 29, so that material excavated by the bore head 14 may be discharged via the pilot shaft 29.

FIG. 1 shows the exemplary embodiment of a device according to the invention at the beginning of a sinking cycle in an axial cycle starting position, in which in this exemplary embodiment the carrier cylinders 11 and the displacement cylinders 13 are in a maximally retracted retracted position, so that the carrier unit 2 is at an absolute minimal distance from the boring unit 3 together with the shaft platform 4 on the shaft floor side and the boring platform 16.

The position of the carrier unit 2 in the sinking direction at the beginning of a sinking cycle is illustrated in FIG. 1 and the subsequent figures by a dash-dotted reference line 31, whose absolute position remains unchanged.

At the beginning of a sinking cycle, the boring unit 3 is braced in the axial and radial directions by means of the bracing modules 15 by extending the bracing cylinders 17 and pressing the bracing plates 18 against the main shaft inner wall 30 of the main shaft 1 in such a way that the forces which act in the radial and axial directions during operation of the bore head 14 are essentially completely absorbed by the boring unit 3.

The bore head 14 of the boring unit 3 is subsequently set in operation for sinking the main shaft 1. The displacement cylinders 13 of the boring unit 3 extend in the sinking direction, depending on the excavating speed in the sinking direction.

FIG. 2 shows a schematic sectional view of the exemplary embodiment according to FIG. 1, in a stage of the sinking cycle in which the displacement cylinders 13, together with the bore head 14 in an advanced position, are now in an extended position. In the illustrated exemplary embodiment, this extended position corresponds to the maximum lift of the displacement cylinders 13. The vertical position of the carrier unit 2 in the arrangement according to FIG. 2 is unchanged compared to the arrangement according to FIG. 1.

FIG. 3 shows the exemplary embodiment according to FIG. 1 in a further stage of a sinking cycle with respect to the arrangement according to FIG. 2, in which the bracing modules 15, starting from the arrangement according to FIG. 2, have been detached from the main shaft inner wall 30 by retracting the bracing cylinders 17, the carrier cylinders 11 have subsequently been extended to an extended position by advancing the boring unit 3 together with the bore head 14, and the displacement cylinders 13 have been retracted to a retracted position with withdrawal of the bore head 14. In the illustrated exemplary embodiment, the extended position of the carrier cylinders 11 illustrated in FIG. 4 corresponds to the maximum lift of the carrier cylinders 11. The boring unit 3 has subsequently been braced again by means of the bracing modules 15 by extending the bracing cylinders 17, with the bracing plates 18 resting against the main shaft inner wall 13.

Starting from the arrangement according to FIG. 3, the bore head 14 is once again set in operation, and the displacement cylinders 13 are once again extended to an extended position in the sinking direction, corresponding to the sinking speed.

FIG. 4 shows a schematic side view of the exemplary embodiment according to FIG. 1 at the end of a sinking cycle, in which, with the position of the carrier unit 2 still unchanged corresponding to the arrangement according to FIG. 1, the displacement cylinders 13 are now once again in a maximally extended position with respect to the arrangement according to FIG. 3.

FIG. 5 shows a schematic side view of the exemplary embodiment according to FIG. 1 at the beginning of the next sinking cycle, for which purpose, compared to the arrangement according to FIG. 1, the carrier unit 2 has now been lowered in the sinking direction by the sum of the extension lifts of the carrier cylinders 11 and of the displacement cylinders 13 by tracking the cables 10 of the suspension unit.

The lowering of the carrier unit 2 and of the boring unit 3 with respect to the arrangement according to FIG. 1 is clearly apparent in FIG. 5 by virtue of the distance of the shaft platform 7 on the shaft opening side from the reference line 31.

In a modified exemplary embodiment, the device according to the invention is configured for moving the carrier cylinders 11 through multiple intermediate positions, from a maximally retracted position to a maximally extended position, before the carrier unit 2 is lowered in the sinking direction.

FIG. 6 shows a schematic side view of a refinement of the exemplary embodiment of a device according to the invention with reference to FIGS. 1 through 5; in the exemplary embodiment according to FIGS. 1 through 5 and in the refinement according to FIG. 6, mutually corresponding elements are provided with the same reference numerals, and their mode of functioning while carrying out the method explained with reference to FIGS. 1 through 5 is not described in greater detail below in order to avoid repetitions. The refinement according to FIG. 6 is configured for lining the main shaft inner wall 30 with tubing elements 32 that are backed by a backfill 33, which is preferably made of concrete. For this purpose, the refinement according to FIG. 6 has a tubing mounting rim 34 which is equipped on the radially outer side with an inflatable tubing mounting sealing ring and which is mounted on the boring platform 16, and, as illustrated in FIG. 6, via which the tubing elements 32 are positionable in the radial direction via radial positioning cylinders 35.

FIG. 7 shows a schematic side view of the refinement according to FIG. 6 with tubing elements 32 situated on the shaft floor side, which as a circumferentially closed tubing ring are pressed against the tubbing elements 32, already completely mounted in the sinking direction, in the axial direction opposite the sinking direction, by means of axial positioning cylinders 36. In addition, it is apparent in the illustration according to FIG. 7 that, after the tubing mounting sealing ring is inflated, for the sealing the material for the backfill 33, preferably liquid concrete, is axially downwardly suppliable, by means of a supply line 37, between the tubbing elements 32 held by the axial positioning cylinders 36 and the main shaft inner wall 30.

FIG. 8 shows a schematic side view of another exemplary embodiment of a device according to the invention; in the exemplary embodiment according to FIG. 8 and in the exemplary embodiment according to FIGS. 1 through 5, mutually corresponding elements are provided with the same reference numerals, and, the same as the procedure for sinking a shaft, in part are not explained in greater detail below. The exemplary embodiment according to FIG. 8 differs from the exemplary embodiment according to FIGS. 1 through 5 and from the refinement according to FIGS. 6 and 7 in that the bore head 14 is closed in the area of the main shaft floor 27.

For discharging material excavated by the bore head 14, the exemplary embodiment according to FIG. 8 is equipped with a conveying unit which has a suction line 38 that opens into the lowest region of the excavation bevel gear 25 on the main shaft floor side and extends away from the boring unit 3 into the carrier unit 2. On the side facing away from the boring unit 3, the suction line 38 opens into a suction container 39 of the conveying unit, which is situated in the carrier unit 2. On its end facing the boring unit 3, the suction container 38 is provided with a pivotable discharge flap 40 and is equipped with a fixed, stationary chute 41 which opens into a conveyor bucket 42 that is movable in the axial direction. Thus, when the discharge flap 40 is opened, material present in the suction container 39 is transferable into the conveyor bucket 42 and dischargable from the main shaft 1 via the conveyor bucket 42.

On the end of the suction container 39 facing away from the boring unit 3, one end of a Y-like connecting line 43 of the conveying unit is present which with its two other ends opens into a first suction fan 44 and a second suction fan 45. A relative negative pressure may be generated via the suction fans 44, 45, by means of which the material that arises during the excavation operation is dischargeable from the floor area of the main shaft 1, which is a single shaft here, via the suction line 38 and the suction container 39.

FIG. 9 shows the exemplary embodiment according to FIG. 8 in a sectional view in the plane IX-IX according to FIG. 8. It is apparent from FIG. 9 that for the conveyor bucket 42 (not illustrated in FIG. 9), a conveyor bucket guide cage 46 is present in order to guide the conveyor bucket 42 in the axial direction. In addition, it is apparent from the illustration according to FIG. 9 that the conveying platform 4 on the shaft floor side bears a number of pieces of operating equipment, such as a shotcrete container 47, a control cabin 48, an electrical cabinet 49, and a hydraulic unit 50. Also apparent in FIG. 9 is a ventilation line 51, via which fresh air is suppliable to the main shaft 1.

In addition, it is particularly clearly apparent from the illustration according to FIG. 9 that the carrier unit 2 is suspended via a plurality of cables 10, which with their ends on the shaft side are anchored in the shaft platform 4 on the shaft zone side.

FIG. 10 shows the exemplary embodiment according to FIG. 8 in a sectional view in the plane X-X from FIG. 8. It is clearly apparent from FIG. 10 how the fixed, stationary chute 41 opens into the conveyor bucket 42, so that the material which is fed into the suction container 39 is reliably dischargeable from the main shaft 1.

FIG. 11 shows a refinement of the exemplary embodiment of a device according to the invention explained with reference to FIGS. 8 through 10; in the exemplary embodiment according to FIGS. 8 through 10 and in the refinement according to FIG. 11, mutually corresponding elements are provided with the same reference numerals, and in part are not explained in greater detail below. The refinement according to FIG. 11 differs from the exemplary embodiment according to FIGS. 8 through 10 in that a first conveyor bucket 52 and a second conveyor bucket 53, represented in dashed lines in the illustration according to FIG. 11, are present in the conveying unit, and during operation are selectively positionable in the carrier unit 2 for efficiently receiving material from the suction container 38. For loading the conveyor buckets 52, 53, a pivotable swivel chute 54 is present which may be oriented toward either the first conveyor bucket 52 or the second conveyor bucket 53.

FIG. 12 shows, in a section along the plane XII-XII according to FIG. 11, a sectional view of the refinement according to FIG. 11, with the swivel chute 54 in a position oriented toward the first conveyor bucket 52. In this orientation, the first conveyor bucket 52 may now be loaded with material from the suction container 39.

FIG. 13 shows the refinement according to FIG. 11 in a section in the plane XII-XII according to FIG. 11, with a second conveyor bucket 53 which is now situated in the area of the carrier unit 2, and a swivel chute 54 which is oriented toward the second conveyor bucket 53. In this orientation of the swivel chute 54, the second conveyor bucket 53 is now fillable with material from the suction container 39 and is removable by extending the second conveyor bucket 53, while the first conveyor bucket 52, not illustrated in FIG. 13, once again returns to the arrangement according to FIG. 12.

FIG. 14 shows a sectional view of another exemplary embodiment of a device according to the invention, which, as an alternative to the exemplary embodiments explained above with a pneumatically operating conveying unit, is equipped with a hydraulically operating conveying unit. In the exemplary embodiment according to FIG. 14, a main conveying line 55 is present, which at one end terminates in the area of the bore head 14, and pumping liquid 57, which is present in the area of the bore head 14, may be pumped out by means of a main conveying pump 56, likewise situated in the area of the bore head 14.

The end of the main conveying line 55 facing away from the bore head 14 opens into a sand trap 58, with which larger components contained in the pumping liquid 57 discharged from the area of the bore head 14 are removable as a coarse-grained discharge 59 into a surge tank 60. For removal from the main shaft 1, the coarse-grained discharge 59 is transferable from the surge tank 60 into a conveyor bucket 42.

The pumping liquid 57, from which the larger components have been removed, and which is discharged from the area of the bore head 14, is transferred into a collection tank 61 downstream from the sand trap 58, and by means of a shaft conveying pump 62 is removed from the main shaft 1 via a shaft conveying line 63.

A shaft return line 64 and a main return line 65 which opens into the area of the bore head 14 are used for delivering pumping liquid 57 to the area of the bore head 14.

FIG. 15 shows the exemplary embodiment according to FIG. 14 in a sectional view along the line XV-XV. It is apparent from the illustration according to FIG. 15 that the coarse-grained discharge 59 is transferable from the surge tank 60 into the conveyor bucket 42 via a stationary chute 41.

FIG. 16 shows the exemplary embodiment according to FIG. 14 in a sectional view along the line XVI-XVI. It is apparent from FIG. 16 that the coarse-grained discharge 59 freely falls into the surge tank 60, which is open in the direction of the sand trap 58.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A device for sinking a shaft in an axial sinking direction, comprising:

a carrier unit disposed on a rear side of the device in the axial sinking direction, the carrier unit positionable in a selected axial cycle start position along the axial sinking direction against a force of gravity;

a boring unit disposed on a front side of the device in the axial sinking direction, the boring unit comprising:

a plurality of bracing modules; and a plurality of displacement cylinders operable in the axial sinking direction;

a plurality of carrier cylinders connecting the carrier unit and the boring unit, the carrier cylinders operable in the axial sinking direction;

the boring unit further comprising a single boring platform on which all of the bracing modules, the displacement cylinders, and the carrier cylinders are mounted; and a bore head connected to the displacement cylinders for sinking the shaft when the bracing modules are activated for bracing.

2. The device of claim 1, further comprising a plurality of cables connected to the carrier unit for positioning the carrier unit.

3. The device of claim 2, wherein the carrier unit includes a shaft platform on which the cables and the carrier cylinders are mounted.

4. The device of claim 1, wherein the carrier cylinders and the displacement cylinders are mounted on a support frame of the boring unit.

5. The device of claim 1, further comprising a pneumatic conveying unit having a suction line via which material excavated by the boring unit is conveyable toward the carrier unit.

6. The device of claim 5, wherein the conveying unit includes two conveyor buckets and a swivel chute via which material excavated by the boring unit is dischargeable by the suction line.

7. The device of claim 1, further comprising a hydraulic conveying unit having a main conveying line via which material excavated by the boring unit is conveyable toward the carrier unit.

8. The device of claim 1, wherein the bracing modules are extendable in a radial direction for bracing the boring unit against a wall of the shaft.

9. The device of claim 1, wherein the boring platform supports a rotary drive for driving the bore head.

10. The device of claim 9, wherein the boring platform includes a support frame, the displacement cylinders connected between the support frame and the rotary drive.

11. The device of claim 1, further comprising a shaft platform disposed on a rear side of the boring platform in the axial sinking direction, the carrier cylinders connected between the shaft platform and the boring platform.

12. The device of claim 1, further comprising a shaft platform disposed on a rear side of the boring platform in the axial sinking direction, the shaft platform including a plurality of radial stabilizers for stabilizing the carrier unit in a radial direction.

13. A method for sinking a shaft using the device of claim 1, comprising the steps of:

a) positioning the carrier unit in a first axial cycle start position with the carrier cylinders in a retracted position and positioning the boring unit at a distance from the carrier unit with the displacement cylinders in a retracted position;

b) bracing the boring platform via the bracing modules;

c) actuating a bore head of the boring unit to sink the shaft by extension of the displacement cylinders to an first extended position;

d) detaching the bracing modules;

e) extending the carrier cylinders to an extended position and retracting the displacement cylinders to a retracted position;

f) bracing the boring platform via the bracing modules;

g) actuating the bore head for further sinking the shaft by extension of the displacement cylinders to a second extended position;

h) detaching the bracing modules;

i) lowering the carrier unit into a second axial cycle start position with retraction of the carrier cylinders and the displacement cylinders to retracted positions; and j) repeating said steps a) through i) until a desired sinking depth is reached.

14. The method of claim 13, wherein the displacement cylinders in said steps a), c), e), g), and i) are selectively disposed in one of a maximally retracted position and a maximally extended position.

15. The method of claim 13, wherein the carrier cylinders in said steps a), e), and i) are selectively disposed in one of a maximally retracted position and a maximally extended position.

16. The method of claim 13, wherein the carrier cylinders in said step e) are selectively disposed in at least one intermediate position between a maximally retracted position and a maximally extended position, and said steps b), c), d), e), f), g), and h) are each carried out with said carrier cylinders selectively disposed in an intermediate position between a maximally retracted position and a maximally extended position, and in said step e), extension of the carrier cylinders is carried out to one of a maximally extended position and an intermediate position between the intermediate position of said steps b), c), d), e), f), g), and h) and the maximally extended position.

* * * * *